US009223282B2

(12) United States Patent
Nakamura

(10) Patent No.: US 9,223,282 B2
(45) Date of Patent: Dec. 29, 2015

(54) IMAGE FORMING APPARATUS

(71) Applicant: CANON KABUSHIKI KAISHA, Tokyo (JP)

(72) Inventor: Takuma Nakamura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/594,297

(22) Filed: Jan. 12, 2015

(65) Prior Publication Data

US 2015/0241834 A1 Aug. 27, 2015

(30) Foreign Application Priority Data

Feb. 25, 2014 (JP) ..... 2014-034221

(51) Int. Cl.
*G03G 15/00* (2006.01)

(52) U.S. Cl.
CPC ..... *G03G 15/757* (2013.01)

(58) Field of Classification Search
CPC ..... G03G 15/0886; G03G 15/0126; G03G 15/06; G03G 15/0872; G03G 15/0875; G03G 15/0877; G03G 15/50; G03G 21/1623; G03G 21/1642; G03G 21/1846
See application file for complete search history.

(56) References Cited

U.S. PATENT DOCUMENTS 7,433,610 B2 * 10/2008 Oyama ..... 399/25
2004/0052538 A1 * 3/2004 Yugeta et al. ..... 399/27

FOREIGN PATENT DOCUMENTS

JP 2000-235396 A 8/2000
JP 2002-040738 A 2/2002
JP 3434492 B2 8/2003
JP 2009-282122 A 12/2009
JP 2010-151940 A 7/2010

* cited by examiner

*Primary Examiner* — Roy Y Yi
(74) *Attorney, Agent, or Firm* — Fitzpatrick, Cella, Harper & Scinto

(57) ABSTRACT

An image forming apparatus, comprising: a rear side plate disposed at the rear side of the main body; and a driving unit mounted on the rear side plate, driving a first driven member and a second driven member of the image forming apparatus, the driving unit including a first frame attached to the rear plate, facing the rear side plate; a second frame attached to the first frame, facing the first plate; a first driving source mounted on the first frame, driving the first driven member; a second driving source mounted on the second frame, driving the second driven member; a first gear train, disposed between the first and second frames, transmitting driving force of the first driving source to the first driven member; and a second gear train, disposed between the first and second frames, transmitting driving force of the second driving source to the second driven member.

20 Claims, 5 Drawing Sheets

IMAGE FORMING APPARATUS

BACKGROUND OF THE INVENTION

1. Field of the Invention

The present invention relates to an image forming apparatus such as a copying machine, a facsimile and a printer.

2. Description of the Related Art

As shown in FIG. 4, a conventional image forming apparatus has the driving unit 48 including a plurality of motors 43 to 45 for driving a plurality of photosensitive drums. The driving unit 48 can be attached to and removed from the base frame 47*c* of the main body of the image forming apparatus.

The driving unit 48 has the front frame 41 and the rear frame 42 which faces the front frame 41. All the motors 43 to 45 of the driving unit 48 are mounted on the rear frame 42. Any motor is not mounted on the front frame 41. In such a configuration, a problem arises where vibration generated by the motors 43 to 45 is transmitted to the rear frame 42 and a radiation sound is generated from the rear frame 42 and the radiation sound is emitted to the outside of the apparatus, thereby increasing noise.

In Japanese Patent Laid-Open No. 2000-235396, noise reduction is intended by designing the apparatus such that the exterior member constitutes a Helmholtz resonator. In addition, there are some configurations where noise reduction is intended by making an exterior member to be a laminated body in which a solid layer and an air layer are alternately laminated, or to be a hollow double-walled structure.

However, in the conventional configurations for achieving noise reduction by an exterior member, a design thereof is complicated and an apparatus becomes large.

Therefore, as shown in Japanese Patent Laid-Open No. 2009-282122, it is conceived to distribute a plurality of motors for driving photosensitive drums to different supporting plates of the driving unit.

However, when such a configuration is employed, the following problem occurs. The positions of supporting plates are different with respect to the axial direction of the photosensitive drum. Therefore, positions of a plurality of motors mounted on the supporting plates are different from each other with respect to the axial direction of the photosensitive drums, and the positions of the gear trains for transmitting the driving force to the photosensitive drums are also different with respect to the axial direction of the photosensitive drums for each supporting plate to which each motor is attached. This necessitates a change of positions of drive input devices of the process cartridge for inputting force from the gear trains depending on the positions of the supporting plates on which the motors are mounted.

SUMMARY OF THE INVENTION

Therefore, an object of the present invention is to provide an image forming apparatus which reduces a radiated sound emitted to the outside of the apparatus with a simple configuration, and which does not require a change of the positions of the drive input devices of the process cartridge for inputting force from the gear trains depending on the positions of the supporting plates on which the motors are mounted.

An image forming apparatus according to this invention, comprising:

an image bearing member which bears an electrostatic latent image;

a rear side plate disposed at the rear side of the main body of the image forming apparatus with respect to the image bearing member; and a driving unit mounted on the rear side plate, the driving unit driving a first driven member and a second driven member of the image forming apparatus, wherein the driving unit includes:

a first frame attached to the rear plate, the first frame being opposed to the rear side plate;

a second frame attached to the first frame, the second frame being opposed to the first frame;

a first driving source mounted on the first frame, the first driving source driving the first driven member;

a second driving source mounted on the second frame, the second driving source driving the second driven member;

a first gear train, disposed between the first frame and the second frame, for transmitting a driving force of the first driving source to the first driven member; and a second gear train, disposed between the first frame and the second frame, for transmitting a driving force of the second driving source to the second driven member.

Further features of the present invention will become apparent from the following description of exemplary embodiments with reference to the attached drawings.

DESCRIPTION OF THE EMBODIMENTS

Figure 1:
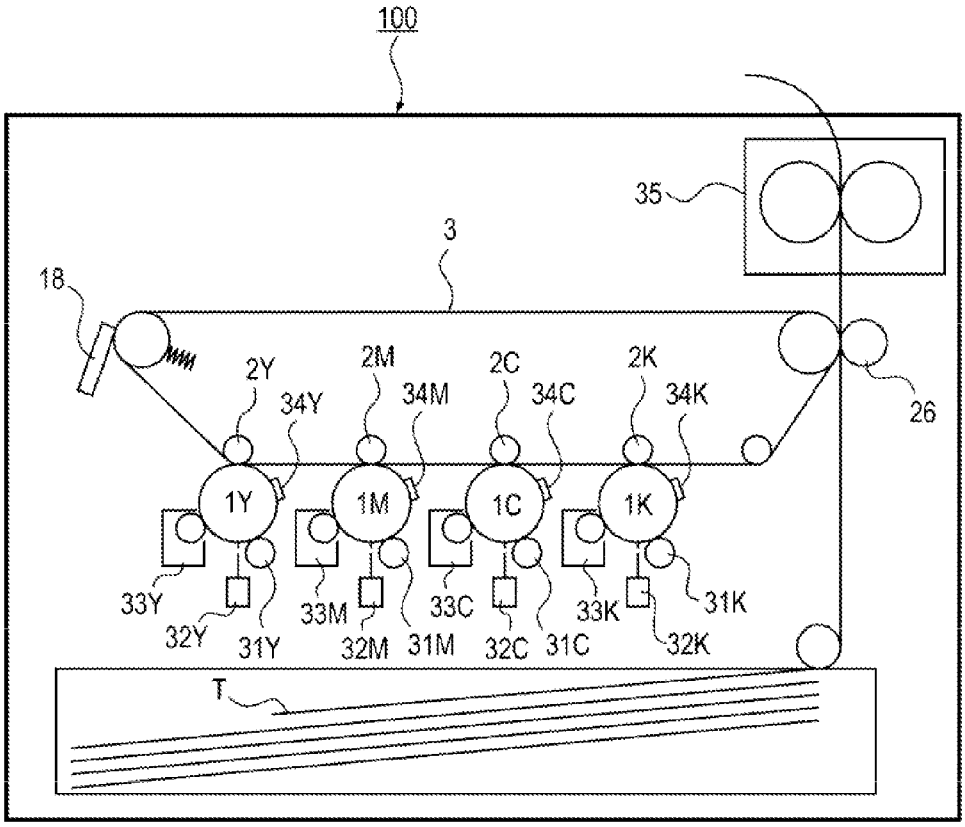
FIG. 1 is a diagram of an image forming apparatus according to an embodiment of the present invention.

An embodiment of an image forming apparatus according to the present invention will be described with reference to the figures. FIG. 1 is a diagram of an image forming apparatus according to the present embodiment. As shown in FIG. 1, the image forming apparatus 100 of the present embodiment has, in the apparatus main body, the four photosensitive drums (image bearing members, driven members) 1Y, 1M, 1C (second driven member) and 1K (first driven member) corresponding to the four colors of yellow Y, magenta M, cyan C and black K, respectively.

The surfaces of the photosensitive drums 1Y to 1K are uniformly charged by the charging unit 31Y to 31K. Then, an electrostatic latent image is formed by irradiating the photosensitive drums 1Y to 1K with a laser beam corresponding to image data by the exposure means 32Y to 32K. The formed electrostatic latent image is developed as a toner image by using the color toners by the developing devices (second driven members) 33Y~33K. The developed toner images of respective colors are primarily transferred and superimposed with each other onto the intermediate transfer belt (second driven member) 3 by the primary transfer rollers 2Y to 2K. The toner image on the intermediate transfer belt 3 is secondarily transferred to the sheet T by the secondary transfer roller 26. The toner image secondarily transferred to the sheet T is fixed with heat and pressure by a fixing unit 35.

Transfer residual toner remaining on the photosensitive drums 1Y to 1K after the primary transfer is collected by the cleaning members 34Y to 34K of the photosensitive drums 1Y to 1K. Furthermore, transfer residual toner remaining after the secondary transfer on the intermediate transfer belt 3 is collected by the belt cleaning member 18.

In addition, the photosensitive drums 1Y to 1K, the charging means 31Y to 31K, the developing devices 33Y to 33K, the cleaning members 34Y to 34K are provided to the process cartridge which is detachable to the apparatus main body of the image forming apparatus 100.

Figure 2:
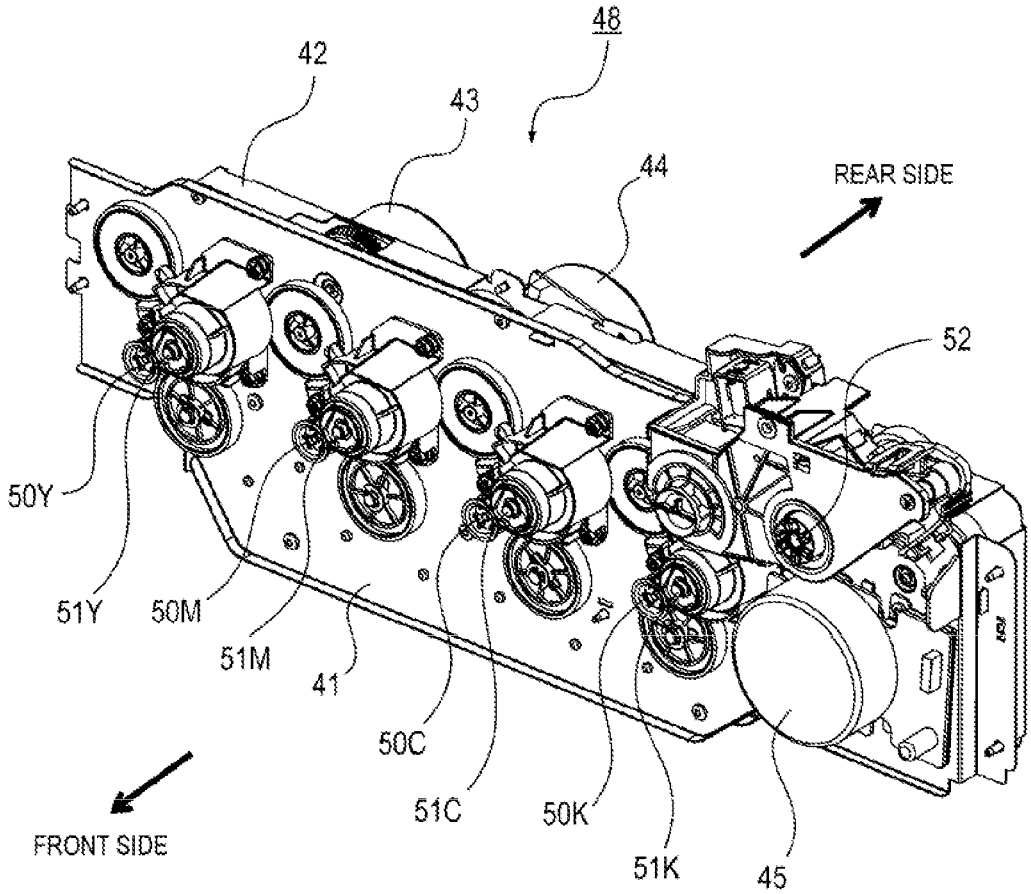
FIG. 2 is a perspective view of a driving unit according to the embodiment of the present invention.
Figure 3:
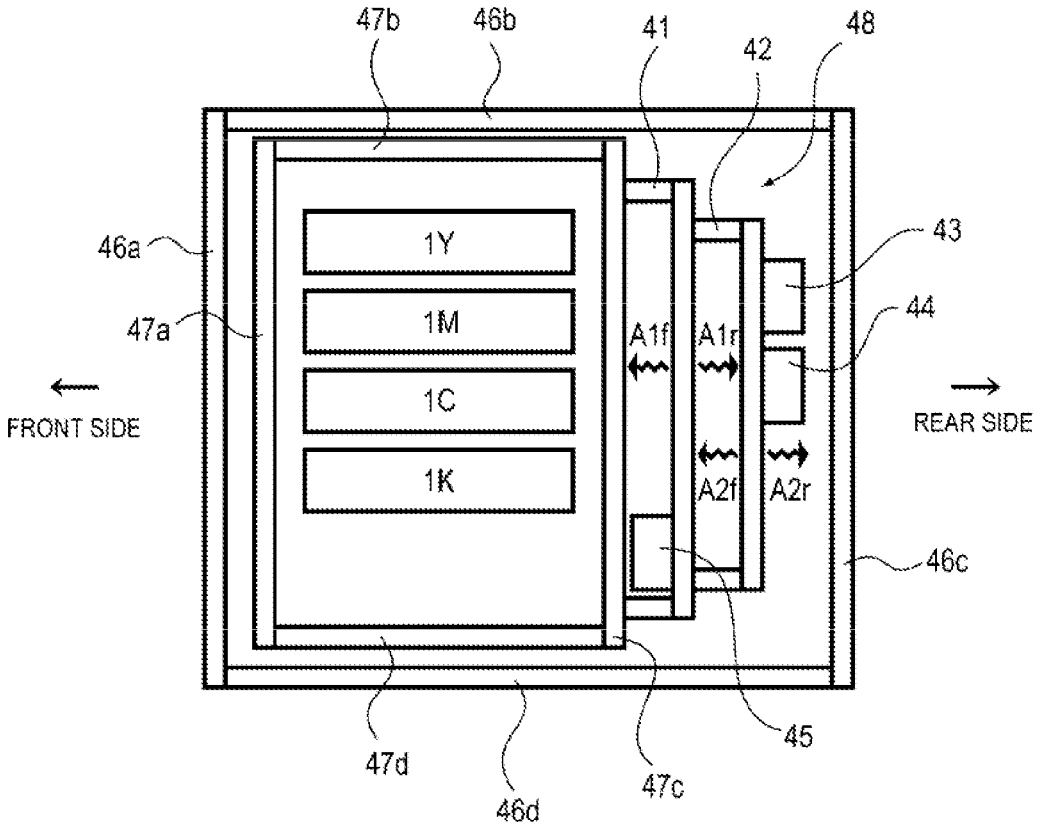
FIG. 3 is a layout view of the driving unit in the entire apparatus according to the embodiment of the present invention.

(Driving unit 48) FIG. 2 is a perspective view of the driving unit 48 of the present embodiment. FIG. 3 is a layout view of the drive unit 48 in the entire apparatus. As shown in FIGS. 2 and 3, the image forming apparatus 100 includes the driving unit 48. The driving unit 48 drives the photosensitive drums 1Y to 1K, the developing devices 33Y to 33K and the intermediate transfer belt 3.

The front frame 41 (first frame) of the drive unit 48 is attached to the base frame 47*c* (rear side plate) of the main body of the apparatus. The front frame 41 is opposed to the base frame 47*c*. The rear frame (second frame) 42 of the driving unit 48 is mounted on the front frame 41. The rear frame 42 is opposed to the front frame 41. The front frame 41 is disposed closer to the front side of the main body of the image forming apparatus than the rear frame 42. The developing motor (second driving source) 43 and the drum motor (second driving source) 44 are mounted on the rear frame 42. The monochrome motor (first driving source) 45 is mounted on the front frame 41 so as to be disposed between the base frame 47*c* and the front frame 41.

The developing motor 43 drives and rotates the main body development couplings (not shown, second coupling members) 50Y, 50M and 50C with output ends of gear trains (not shown, second gear trains) disposed between the frames 41 and 42 thereby the developing devices 33Y, 33M and 33C are driven and rotated through the unit development couplings (not shown, second coupling members).

The drum motor 44 drives and rotates the main body drum couplings (second coupling member) 51Y, 51M and 51C with output ends of gear trains (not shown, second gear trains) disposed between the frames 41 and 42 thereby the photosensitive drums 1Y, 1M and 1C are driven and rotated through unit drum couplings (not shown, second coupling members).

The monochrome motor 45 drives and rotates main body drum couplings 51K (first coupling member) and unit drum couplings (not shown, first coupling members) through output ends of gear trains (not shown, first gear trains), and thereby the photosensitive drum 1K is driven. Also, the monochrome motor 45 drives and rotates the developing device 33K through the main body development coupling 50K (first coupling member) and a unit development coupling (not shown, first coupling member) through an output end of a gear train (not shown, first gear train) disposed between the frames 41 and 42.

Also, the monochrome motor 45 drives the intermediate transfer belt 3 through a gear train (not shown, a first gear train) disposed between the frames 41 and 42, the main body intermediate transfer coupling 52 and a unit intermediate transfer coupling (not shown, first coupling member). In addition, the main body intermediate transfer coupling 52 is provided above the monochrome motor 45, thereby to save space.

Thus, the developing motor 43 and the drum motor 44 are mounted on the frame 42 and the monochrome motor 45 is mounted on the frame 41. However, the output force of each motor is outputted through the gear train provided between the frames 41 and 42 and is transmitted to the driven member such as a photosensitive drum. Therefore, it is not necessary to change the position of the drive input device of the process cartridge for inputting force from the gear trains depending on the position of the supporting plate on which the motor is mounted.

The main body of the image forming apparatus has the framework of the base frame 47*a* (front side plate), 47*b*, 47*c* (rear side plate) and 47*d*. The photosensitive drums 1Y to 1K are provided between the base frame 47*a* (front side plate) and the base frame 47*c* (rear side plate) at a position near the front side. The photosensitive drums 1Y to 1K are disposed inside the space formed by the base frames 47*a* to 47*d*. The driving unit 48 is mounted on the base frame 47*c* as described above. Thus, with this structure, radiation noise generated by the driving unit 48 does not easily reach the front side of the main body of the image forming apparatus. The exterior materials 46*a*, 46*b*, 46*c* and 46*d* surround the base frames 47*a*, 47*b*, 47*c* and 47*d* and the outer periphery of the driving unit 48.

(Radiated sound generated from the driving unit 48) During image formation, the rear frame 42 is vibrated when the developing motor 43 and the drum motor 44 rotate. By the vibration of rear frame 42, the sound A2*f* is emitted to the front side of the rear frame 42, and the sound A2*r* is emitted to the rear side of the rear frame 42. The sound A2*f* emitted to the front side reaches the exterior material 46 after the sound A2*f* is damped by the front frame 41, and thereby the noise energy of the sound A2*f* emitted outside the apparatus is small. The sound A2*r* emitted to the rear side reaches the exterior material 46 without being damped, and thereby the noise energy of the sound A2*r* outputted outside the apparatus is large.

Also, the front frame 41 is vibrated when the monochrome motor 45 rotates.

By the vibration of the front frame 41, the sound A1*f* is emitted to the front side of the front frame 41, and the sound A1*r* is emitted to the rear side of the front frame 41. The sound A1*f* emitted to the front side reaches the exterior material 46 after the sound A1*f* is damped by the base frame 47*c* and so on, and thereby the noise energy of the sound A1*f* outputted outside the apparatus is small. Moreover, the sound A1*r* emitted to the rear side reaches the exterior material 46*c* after the sound A1*r* is damped by the rear frame 42 and so on, and thereby the noise energy emitted outside the apparatus is small.

Figure 4:
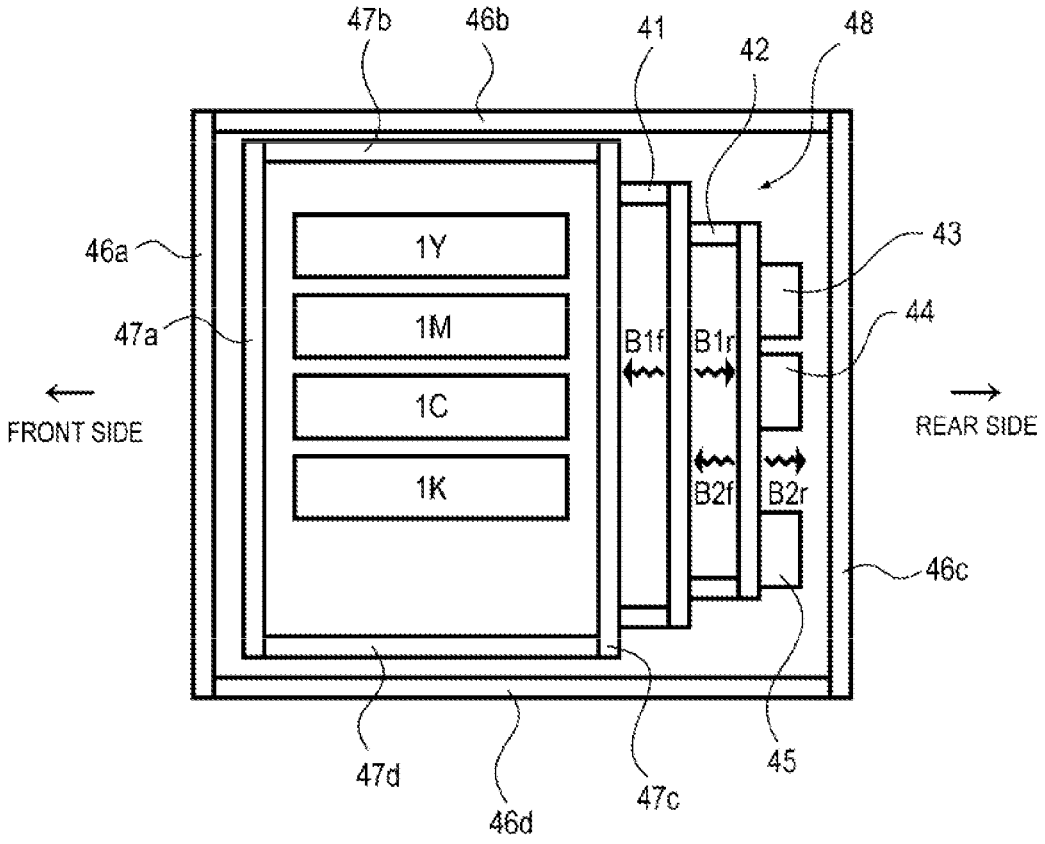
FIG. 4 is a layout view of a conventional driving unit in the entire apparatus.

(Comparison of a radiated sound generated from the driving unit 48 in this embodiment with that of a conventional configuration) FIG. 4 is a layout view of the conventional drive unit 48 in the entire apparatus. As shown in FIG. 4, in the conventional configuration, the monochrome motor 45 is mounted on the rear frame 42. That is, the developing motor 43, the drum motor 44 and monochrome motor 45 are mounted on the rear frame 42 and any motor is not mounted on the front frame 41.

Since the conventional configuration is the same as the configuration of the present embodiment except for the arrangement of the monochrome motor 45, a detailed description thereof will be omitted. Conditions on rotational speeds and torques of the developing motor 43, the drum motor 44 and the monochrome motor 45 are identical to those of the present embodiment.

In the conventional configuration, when the developing motor 43, drum motor 44, the monochrome motor 45 rotate, the rear frame 42 is vibrated. By the vibration of the rear frame 42, the sound B2*f* is emitted to the front side of the rear frame 42, and the sound B2*r* is emitted to the rear side of the rear frame 42. The sound B2*f* emitted to the front side reaches the exterior material 46 after the sound B2*f* is damped by the front frame 41, and thereby the noise energy of the sound B2*f* emitted outside the apparatus is small. On the other hand, the sound B2*r* emitted to the rear side reaches the exterior material 46 without being damped by any frames and so on, and thereby the noise energy emitted outside the apparatus is large.

The vibration of the rear frame 42 is transmitted to the front frame 41. By the vibration of the front frame 41, the sound B1*f* is emitted to the front side of the front frame 41, and the sound B1*r* is emitted to the rear side of the front frame 41. The vibration transmitted to the front frame 41 is damped at the portion connecting the front frame 41 and rear frame 42, and thereby the vibration of the front frame 41 becomes small. In other words, the sounds B1*f* and B1*r* generated by the vibration of the front frame 41 are smaller than the sounds A1*f* and A1*r* of the present embodiment. In addition, the sound B1*f* reaches the exterior material 46 after the sound B1*f* is damped by the base frame 47*c*, and thereby the noise energy of the sound B1*f* emitted outside the apparatus is small. The sound B1*r* reaches the exterior material 46 after the sound B1*r* is damped by the rear frame 42, and thereby the noise energy of the sound B1*r* emitted outside the apparatus is also small.

In the conventional configuration, the monochrome motor 45 is additionally disposed on the rear frame 42. Therefore, the sounds B2*f* and B2*r* generated by the vibration of the rear frame 42 of the conventional configuration are larger than the sounds A2*f* and A2*r* generated by the vibration of the rear frame 42 of the present embodiment.

After the sounds A1*f*, A1*r*, A2*f* and A2*r* of this embodiment are emitted outside the apparatus, the noise energies A1*f*', A1*r*', A2*f*' and A2*r*' are captured by the human ear as a synthesized noise energy A. The synthetic noise energy A has a large proportion of the noise energy A2*r*'. Similarly, after the sounds B1*f*, B1*r*, B2*f* and B2*r* of the conventional configuration are emitted outside the apparatus, the noise energies B1*f*', B1*r*', B2*f*' and B2*r*' are captured by the human ear as a synthesized noise energy B. The synthetic noise energy B has a large proportion of the noise energy B2*r*'.

Then, as described above, since the sound B2*r* of the conventional configuration is larger than the sound A2*r* of this embodiment, A2*r*'<B2*r*'. Therefore, the magnitude relationship between the noise energy A emitted from the apparatus of this embodiment and the noise energy B emitted from the apparatus of the conventional configuration is A<B. That is, as compared with the conventional configuration, the drive unit 48 of this embodiment can reduce the noise energy emitted outside the apparatus.

When the present embodiment is compared with the conventional configuration in the case where the developing motor 43, the drum motor 44 and the monochrome motor 45 are rotated, the sound level outside the apparatus of the present embodiment is 43.9 dB and the sound level outside the apparatus of the conventional configuration is 45.6 dB. That is, it is confirmed that the sound level of this embodiment is lower than that of the conventional configuration by 1.8 dB. In general, since the difference of 1 dB in the sound level can be recognized by a human, this embodiment can sufficiently reduce the noise energy emitted outside the apparatus.

Figure 5:
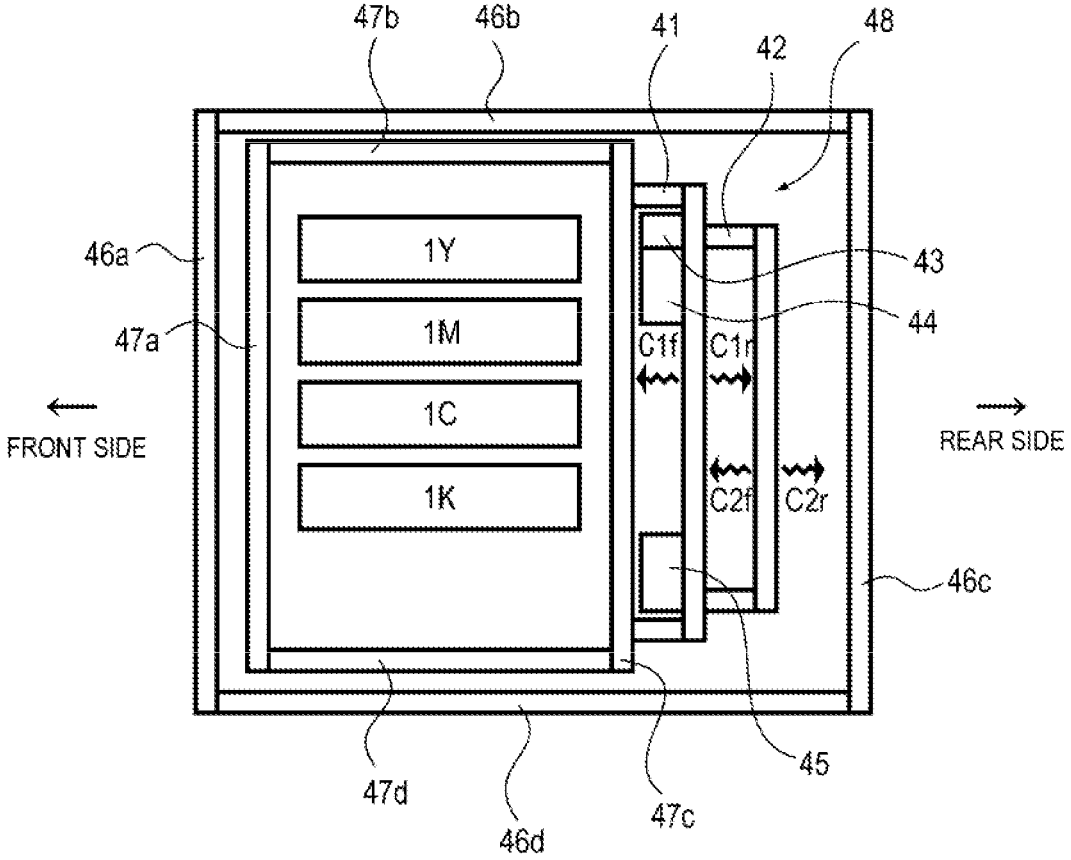
FIG. 5 is a layout view of a driving unit of a comparative example in the entire apparatus.

As shown in FIG. 5, in the configuration where all the motors 43 to 45 of the driving unit 48 are mounted on the front frame 41 and any motor is not mounted on the rear frame 42, the sound C2*r* emitted to the rear side of the rear frame 42 is smaller than the sound A2*r* or the sound B2*r*. Therefore, the noise energy emitted to the outside of the apparatus of the above configuration is smaller than that of the present embodiment. However, the front frame 41 is directly fixed to the base frame 47 of the main body of the apparatus. When the vibration the front frame 41 emits exceeds a predetermined level, the vibration transmitted to the base frame 47 becomes large. This vibration is transmitted to the photosensitive drum 1 and exposure unit 32 of the image forming unit, thereby banding on an image may occur due to pitch unevenness based on a vibration cycle.

Therefore, in this embodiment, the noise energy emitted to the outside of the apparatus is reduced by not mounting all the motors 43 to 45 of the drive unit 48 on the rear frame 42. In addition, large vibration transmitted to the photosensitive drum 1 and the exposure unit 32 is avoided and the occurrence of banding is suppressed by not mounting all the motors 43 to 45 on the front frame 41. From the above, it is possible for this embodiment to reduce the level of the sound emitted to the outside of the apparatus with a simple configuration thereby to reduce noise without complicated design of the exterior material.

In the present embodiment, the developing motor 43 and the drum motor 44 are mounted on the rear frame 42 and the monochrome motor 45 is mounted on the front frame 41. However, the present invention is not limited to this configuration. The configuration may be another one as long as at least one motor is mounted on the front frame 41 and the rear frame 42, respectively.

For example, the configuration may be employed in which a motor having the heaviest load among the plurality of driving sources (motors 43 to 45) is mounted on the front frame 41. According to this configuration, vibration of the rear frame 42 can be reduced thereby the radiated sound B2*r* and noise can be reduced.

According to the present invention, it is possible to reduce the sound and noise emitted to the outside of the apparatus with a simple configuration without complicated design of the exterior material. Furthermore, according to the present invention, there is no need to change the positions of the drive input devices of the process cartridge for inputting force from the gear trains depending on the positions of the supporting plates on which the motors are mounted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034221, filed Feb. 25, 2014 which is hereby incorporated by reference herein in its entirety.

What is claimed is:

1. An image forming apparatus, comprising:

an image bearing member which bears an electrostatic latent image;

a rear side plate disposed at a rear side of a main body of the image forming apparatus with respect to the image bearing member; and a driving unit mounted on the rear side plate, the driving unit driving a first driven member and a second driven member of the image forming apparatus, wherein the driving unit includes:

a first frame attached to the rear side plate, the first frame being opposed to the rear side plate;

a second frame attached to the first frame, the second frame being opposed to the first frame;

a first driving source mounted on the first frame, the first driving source driving the first driven member;

a second driving source mounted on the second frame, the second driving source driving the second driven member;

a first gear train, disposed between the first frame and the second frame, for transmitting a driving force of the first driving source to the first driven member; and a second gear train, disposed between the first frame and the second frame, for transmitting a driving force of the second driving source to the second driven member.

2. The image forming apparatus according to claim 1, wherein a load of the first driving unit is heavier than a load of the second driving unit.

3. The image forming apparatus according to claim 1, wherein the drive unit further comprises:

a first coupling member, disposed between the rear side plate and the first frame, for connecting an output end of the first gear train to the first driven member; and a second coupling member, disposed between the rear side plate and the first frame, for connecting an output end of the second gear train to the second driven member.

4. The image forming apparatus according to claim 2, wherein the drive unit further comprises:

a first coupling member, disposed between the rear side plate and the first frame, for connecting an output end of the first gear train to the first driven member; and a second coupling member, disposed between the rear side plate and the first frame, for connecting an output end of the second gear train to the second driven member.

5. The image forming apparatus according to claim 1, wherein each of the first driven member and the second driven member is any one of the image bearing member, an intermediate transfer belt and a developing device.

6. The image forming apparatus according to claim 2, wherein each of the first driven member and the second driven member is any one of the image bearing member, an intermediate transfer belt and a developing device.

7. The image forming apparatus according to claim 3, wherein each of the first driven member and the second driven member is any one of the image bearing member, an intermediate transfer belt and a developing device.

8. The image forming apparatus according to claim 4, wherein each of the first driven member and the second driven member is any one of the image bearing member, an intermediate transfer belt and a developing device.

9. The image forming apparatus according to claim 5, further comprising a plurality of image bearing members which bear an electrostatic latent image, wherein each of the first driven member and the second driven member is any one of the plurality of image bearing members.

10. The image forming apparatus according to claim 6, further comprising a plurality of image bearing members which bear an electrostatic latent image, wherein each of the first driven member and the second driven member is any one of the plurality of image bearing members.

11. The image forming apparatus according to claim 7, further comprising a plurality of image bearing members which bear an electrostatic latent image, wherein each of the first driven member and the second driven member is any one of the plurality of image bearing members.

12. The image forming apparatus according to claim 8, further comprising a plurality of image bearing members which bear an electrostatic latent image, wherein each of the first driven member and the second driven member is any one of the plurality of image bearing members.

13. The image forming apparatus according to claim 9, wherein the plurality of the image bearing members are provided in a detachably attachable process cartridge of the main body of the image forming apparatus.

14. The image forming apparatus according to claim 10, wherein the plurality of the image bearing members are provided in a detachably attachable process cartridge of the main body of the image forming apparatus.

15. The image forming apparatus according to claim 11, wherein the plurality of the image bearing members are provided in a detachably attachable process cartridge of the main body of the image forming apparatus.

16. The image forming apparatus according to claim 12, wherein the plurality of the image bearing members are provided in a detachably attachable process cartridge of the main body of the image forming apparatus.

17. The image forming apparatus according to claim 5, wherein the first driving source is disposed between the rear side plate and the first frame.

18. The image forming apparatus according to claim 6, wherein the first driving source is disposed between the rear side plate and the first frame.

19. The image forming apparatus according to claim 7, wherein the first driving source is disposed between the rear side plate and the first frame.

20. The image forming apparatus according to claim 8, wherein the first driving source is disposed between the rear side plate and the first frame.

* * * * *